US007064718B1

(12) United States Patent
Wang

(10) Patent No.: US 7,064,718 B1
(45) Date of Patent: Jun. 20, 2006

(54) INDOOR UHF ANTENNA DEVICE FOR A DIGITAL TELEVISION

(75) Inventor: Cheng-Si Wang, Changhua Hsien (TW)

(73) Assignee: Trans Electric Co., Ltd., Changhua Hsien (TW)

( * ) Notice: Subject to any disclaimer, the term of this patent is extended or adjusted under 35 U.S.C. 154(b) by 0 days.

(21) Appl. No.: 11/050,854

(22) Filed: Jan. 27, 2005

(51) Int. Cl.
*H01Q 1/24* (2006.01)
*H01Q 9/30* (2006.01)

(52) U.S. Cl. ..... 343/702; 343/900; 343/833; 343/834

(58) Field of Classification Search ..... 343/702, 343/900, 833, 834
See application file for complete search history.

(56) References Cited

U.S. PATENT DOCUMENTS 5,818,392 A * 10/1998 Oka et al. ..... 343/702
6,239,755 B1 * 5/2001 Klemens et al. ..... 343/702
6,437,577 B1 * 8/2002 Fritzmann et al. ..... 324/523
6,720,929 B1 * 4/2004 Nybeck et al. ..... 343/727
6,731,920 B1 * 5/2004 Iwai et al. ..... 455/272
6,947,011 B1 * 9/2005 Kukita et al. ..... 343/906
6,985,113 B1 * 1/2006 Nishimura et al. ..... 343/702
2005/0110692 A1 * 5/2005 Andersson ..... 343/702

* cited by examiner

*Primary Examiner*—HoangAnh Le
*Assistant Examiner*—Tung Le
(74) *Attorney, Agent, or Firm*—Hershkovitz & Associates; Abe Hershkovitz

(57) ABSTRACT

An indoor UHF antenna for a digital television includes a flat structure, which is easy to install and also can be adjusted to different receiving angles according to horizontal polarized waves or vertical polarized waves transmitted by different transmitters. The antenna device includes a circuit board, a main rod antenna, and an auxiliary rod antenna. The main rod antenna is horizontally welded with a signal feeder terminal of the circuit board, and the auxiliary rod antenna is parallel welded with an earth terminal of the circuit board for stabilizing signals. Thereby the whole antenna structure is flat and can be adjusted to any receiving angle easily, so as to match up and be suitable to receive wireless digital television signals of the horizontal polarized waves or vertical polarized waves from different transmitters.

10 Claims, 6 Drawing Sheets

INDOOR UHF ANTENNA DEVICE FOR A DIGITAL TELEVISION

BACKGROUND OF THE INVENTION

1. Field of the Invention

The invention relates in general to an indoor UHF antenna device, and more particularly to an indoor UHF antenna device for a digital television, which is easy to be adjusted to different angles to receive wireless signals of polarized waves of different directions.

2. Description of the Related Art

Referring to FIG. 6, a conventional digital antenna 50 for a digital television 1 is shown. The digital antenna 50 includes a base 51 and a rod body 53 supported by the base 51. The rod body 53 is an antenna. When using the digital antenna 50, the base 51 is connected with an earth terminal of a television cable, and the rod body 53 is connected to a signal input terminal of the television cable.

According to FIG. 6, it is clear that the digital antenna receives wireless signals in a direction perpendicular to the level. However, a conventional digital television transmitter generally includes horizontal polarized waves and vertical polarized waves. If it is desired to receive all kinds of wireless signals from different transmitters, the receiving angle of the antenna requires adjusting. Take the antenna structure of FIG. 6 for example; the antenna can receive clear signals of the vertical polarized waves, but not simultaneously with horizontal waves. If it is desired to receive clear signals of the horizontal polarized waves, the whole antenna must be put horizontal. Nevertheless, this kind, the antenna is quite bulky and lacks a design for easy adjustment of receiving angles. Thereby the conventional antenna is not suitable to adjust the angles for receiving the signals.

SUMMARY OF THE INVENTION

An antenna for receiving wireless signals transmitted by digital television transmitters and having a flat structure is provided, which is easy to install and also can be adjusted to different receiving angles according to horizontal polarized waves or vertical polarized waves transmitted by different transmitters.

According to an objective of the present invention, an antenna device is provided mainly including a circuit board, a main rod antenna, and an auxiliary rod antenna. The circuit board mainly comprises a signal wave filter, an amplifier, a digital television signal processing circuit and a connector for connecting with a coaxial cable. The main rod antenna is horizontally welded with a signal feeder terminal of the circuit board, so as to be parallel to the circuit board. The auxiliary rod antenna is horizontally welded with an earth terminal of the circuit board and keeps a specific wavelength distance with the main rod antenna. The auxiliary rod antenna is provided as a reference signal. While the circuit of the circuit board processes a signal received by the main rod antenna, reception of reflected or refracted wireless signals from surrounding obstacles is prevented, so as to avoid receiving the same wireless signals repeatedly and thus avoid a signal receiving noise.

The antenna device includes the circuit board, the main rod antenna and the auxiliary rod antenna, which are integrated together in a parallel direction. Thereby the whole antenna device is flat and can be versatile for installation space and for easy adjustment of receiving angles.

DETAILED DESCRIPTION OF THE INVENTION

Figure 1:
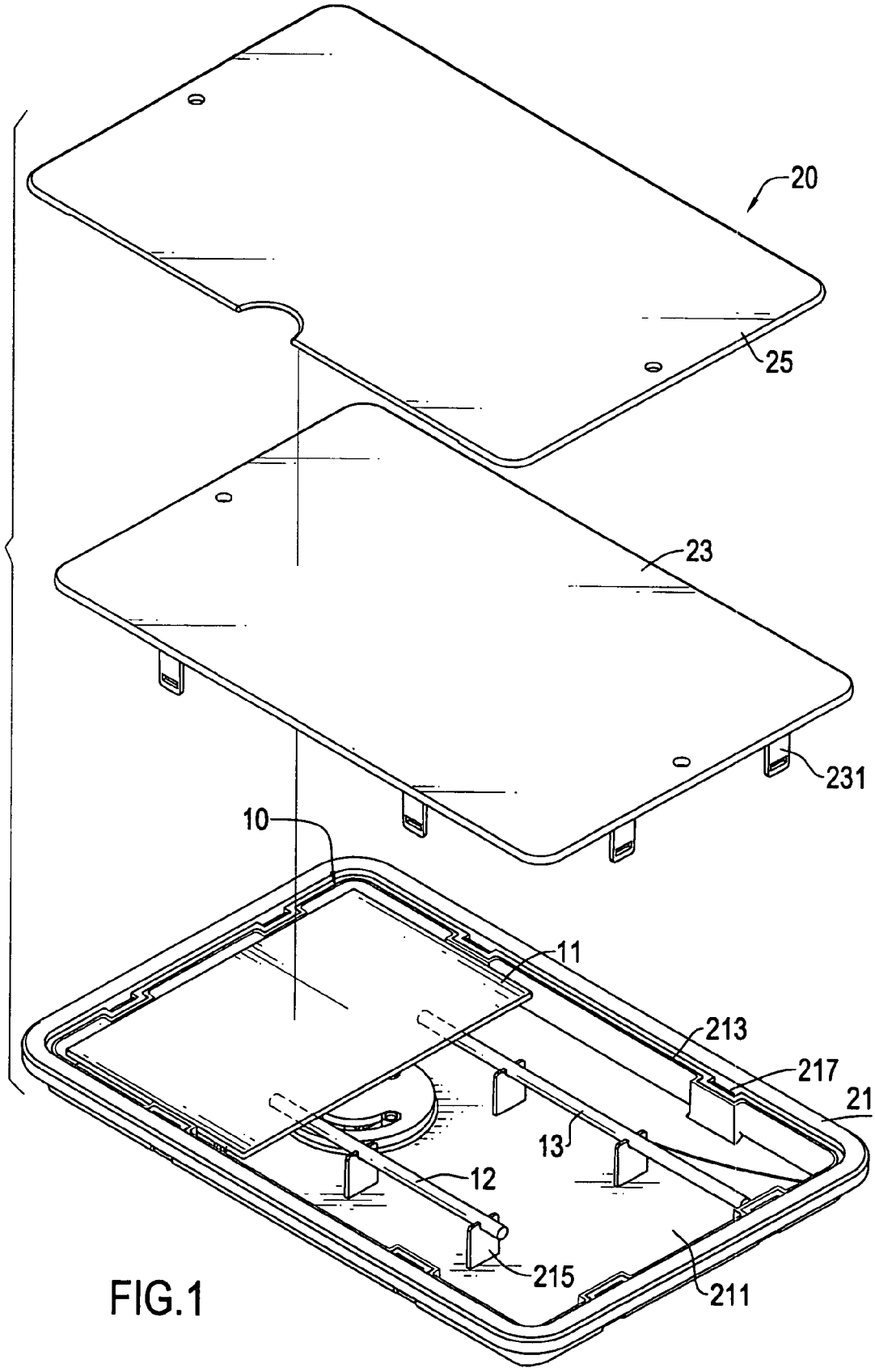
FIG. 1 is an exploded perspective view of a preferred embodiment of the present invention.
Figure 4:
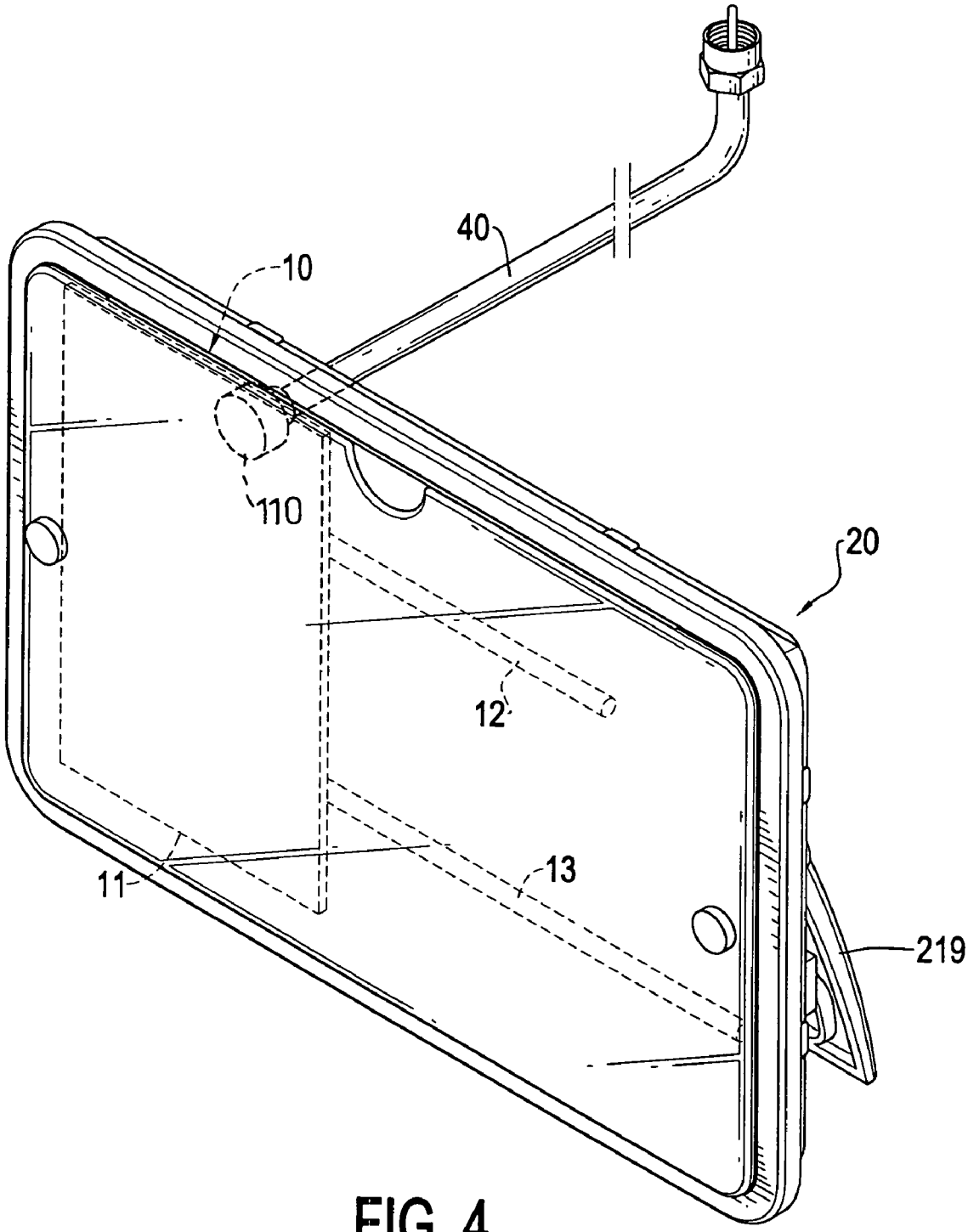
FIG. 4 is a perspective view of the present invention in coordination with a coaxial cable.

Referring to FIG. 1 and FIG. 4, a preferred embodiment of the present invention is shown. An antenna device 10 for receiving wireless signals transmitted by digital television transmitters and having a flat structure is provided, which includes a circuit board 11, a main rod antenna 12, and an auxiliary rod antenna 13. The circuit board 11 mainly includes a digital television signal processing circuit (not shown in the diagram) and a connector 110 for connecting a coaxial cable. The main rod antenna 12 is horizontally welded with a signal feeder terminal (not shown in the diagram) of the circuit board 11, so as to be parallel to the circuit board 11. The auxiliary rod antenna 13 is parallel welded with an earth terminal (not shown in the diagram) of the circuit board 11 and keeps a specific wavelength distance with the main rod antenna 12 in parallel. The auxiliary rod antenna 13 is provided as a reference signal. While the circuit of the circuit board processes a signal received by the main rod antenna 12, reception of reflected or refracted wireless signals from surrounding obstacles is prevented so as to avoid receiving the same wireless signals repeatedly and thus avoid a signal receiving noise.

Figure 2:
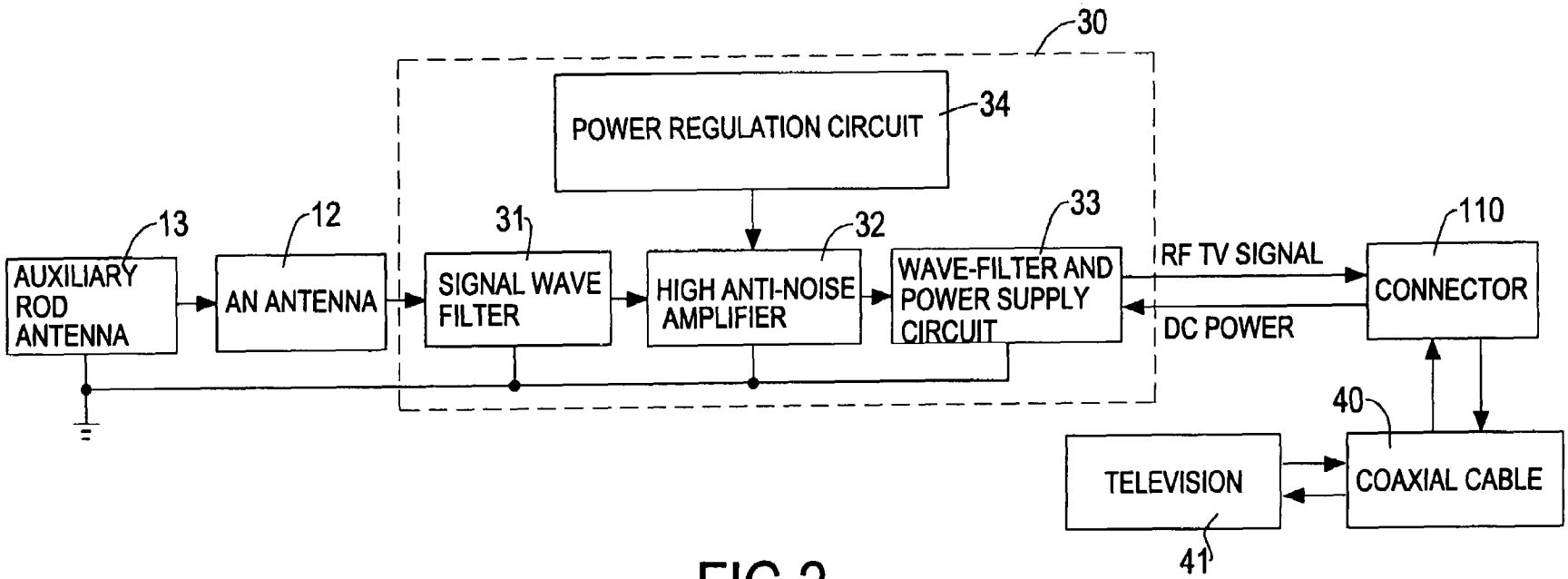
FIG. 2 is a block diagram of a digital television signal processing circuit of the present invention.
Figure 3:
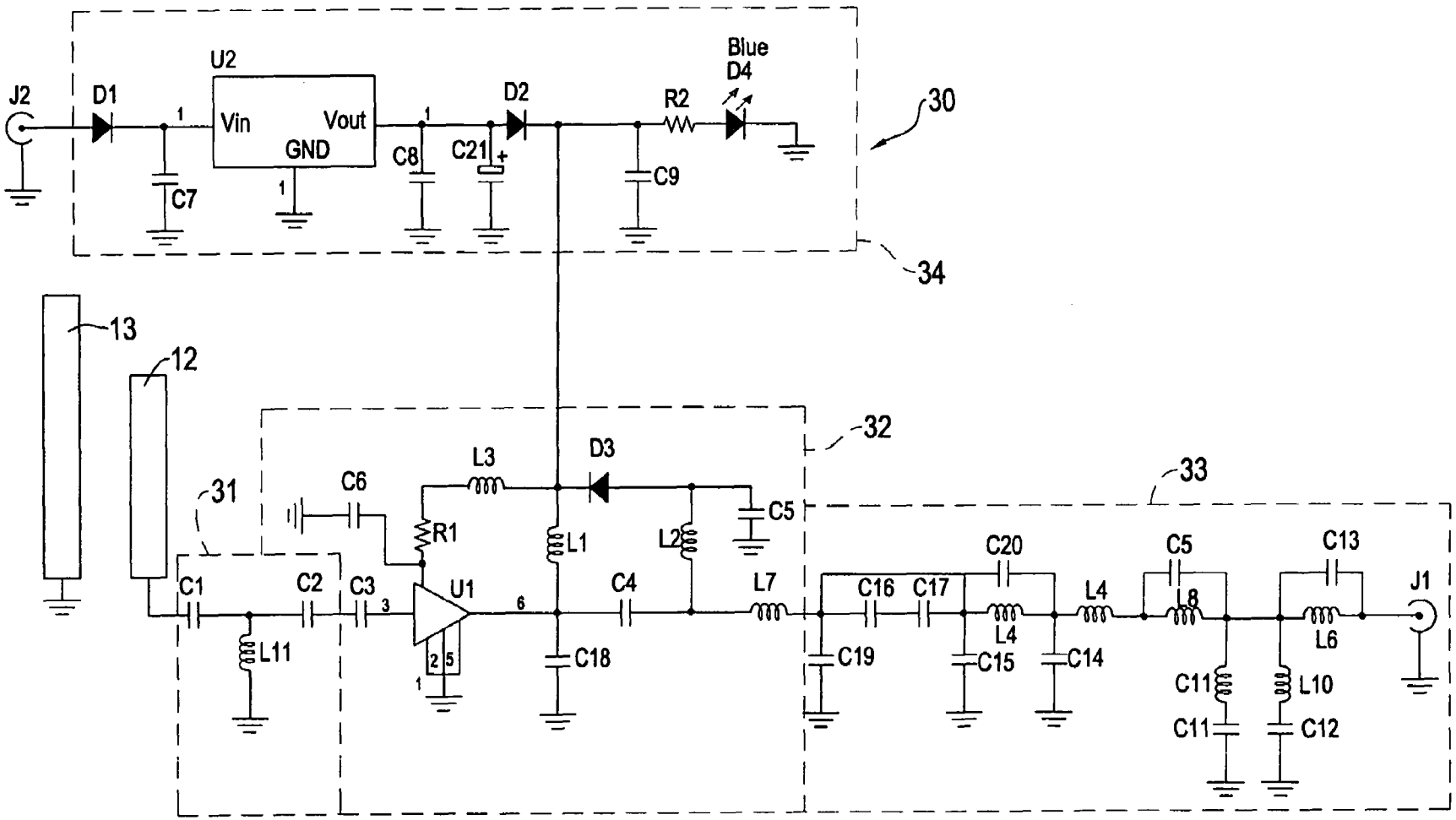
FIG. 3 is a detailed circuit diagram of FIG. 2.

Referring to FIG. 2 and FIG. 3, a preferred embodiment of an example of the present invention of a digital television signal processing circuit 30 is shown. Since the antenna device 10 of the present invention is for receiving the digital television signals, noise signals require processing to receive the genuine digital signals, so as to keep clarity of television signals. Thereby the digital television signal processing circuit 30 of the present invention includes a signal wave filter 31, a high anti-noise amplifier 32, a wave-filter and power supply circuit 33, and a power regulation circuit 34. The signal wave filter 31 includes a signal feeder terminal connecting to the main rod antenna 12 for capturing a wireless signal of a specific frequency band, which can receive the frequency band of 50 MHZ~870 MHZ. The high anti-noise amplifier 32 is connected to an output terminal of the signal wave filter 31 for filtering the noise of the wireless signal and then to amplify and output the signal. The wave-filter and power supply circuit 33 includes an input terminal connected to an output terminal of the high anti-noise amplifier 32, so as to filter the amplified wireless signal again, and to capture a digital television signal of a UHF frequency band, which is 470~870 MHZ. On the other hand, an output terminal of the wave-filter and power supply circuit 33 is connected to the connector 110 of the circuit 10. When the connector 110 is connected to a television via the coaxial cable 40, D.C. power occurs. Further the wave-filter and power supply circuit 33 includes inductance and capacitance, thereby when the output terminal of the wave-filter and power supply circuit 33 is connected to the connector 110, the D.C. power is supplied to the high anti-noise amplifier 32 via the capacitance. The power regulation circuit 34 includes an input terminal connected to a D.C. power. The input D.C. power is then outputted to the high anti-noise amplifier 32 via a constant voltage regulator U2.

Referring back to FIG. 1, in order to facilitate users to adjust angles of the antenna device 10 of the present invention conveniently, the antenna device 10 can be placed inside a casing 20 which includes a base 21, a lid 23 and a plate 25. The base 21 includes a U-shaped cross-section. A plurality of upward mounts 215 are configured at a sunken bottom 211 of the base 21 for supporting the main rod antenna 12 and the auxiliary rod antenna 13. The circuit board 11 is also stored inside the base 21. Besides, four sides of the base 21 form a ladder 213 at an inner part respectively, and a plurality of integrated troughs 217 is formed on the ladder 213. A plurality of integrated feet 231 are formed on an underside of the lid 23 corresponding to the integrated troughs 217 on the ladder 213 of the side of the base 21, so that the integrated feet 23 of the lid 23 can be integrated with the integrated troughs 217 on the ladder of the base 21. The plate covers the lid 23 and also connects with the base 21 for stiffening the base 21.

When the antenna device 10 of the present invention is combined with the casing 20, the main rod antenna 12 and the auxiliary rod antenna 13 are supported by the mounts 215, so as to fix and configure them inside the casing 20. Subsequently, the integrated feet 231 of the lid 23 plug in the corresponding integrated troughs 217, so as to integrate the lid 23 on the base 21. The plate 25 then covers the lid 23, and securing elements such as screws are used to fasten the plate 25 on the lid 23, so as to be stably integrated with the base 21.

Figure 5A:
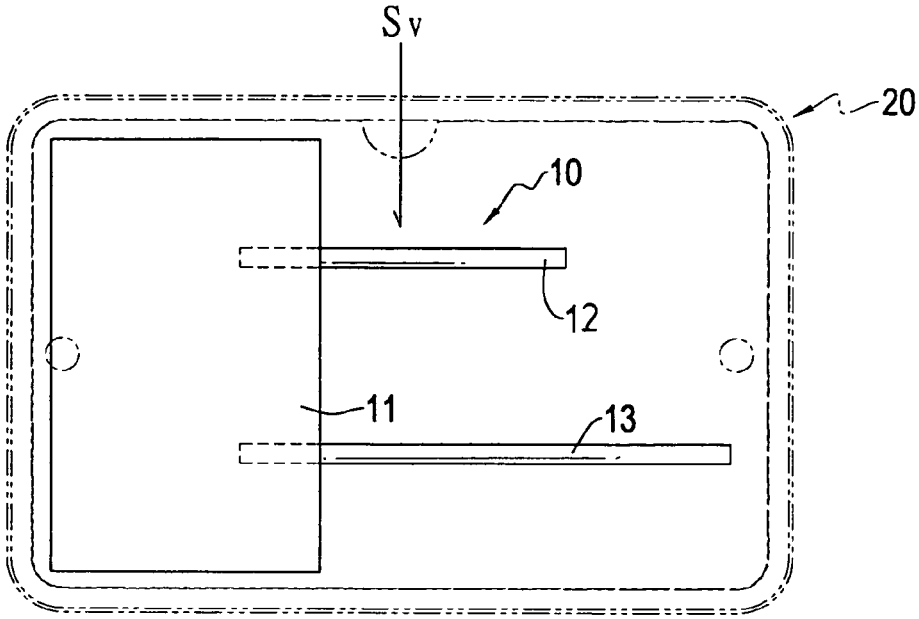
FIG. 5A and FIG. 5B show diagrams of the present invention when adjusted to different angles.
Figure 5B:
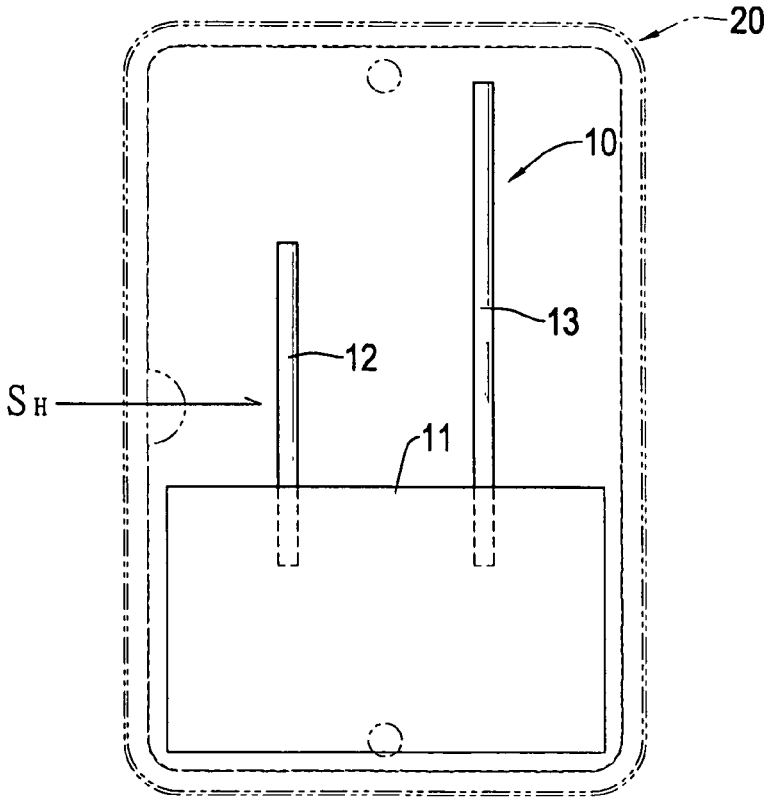
Figure 6:
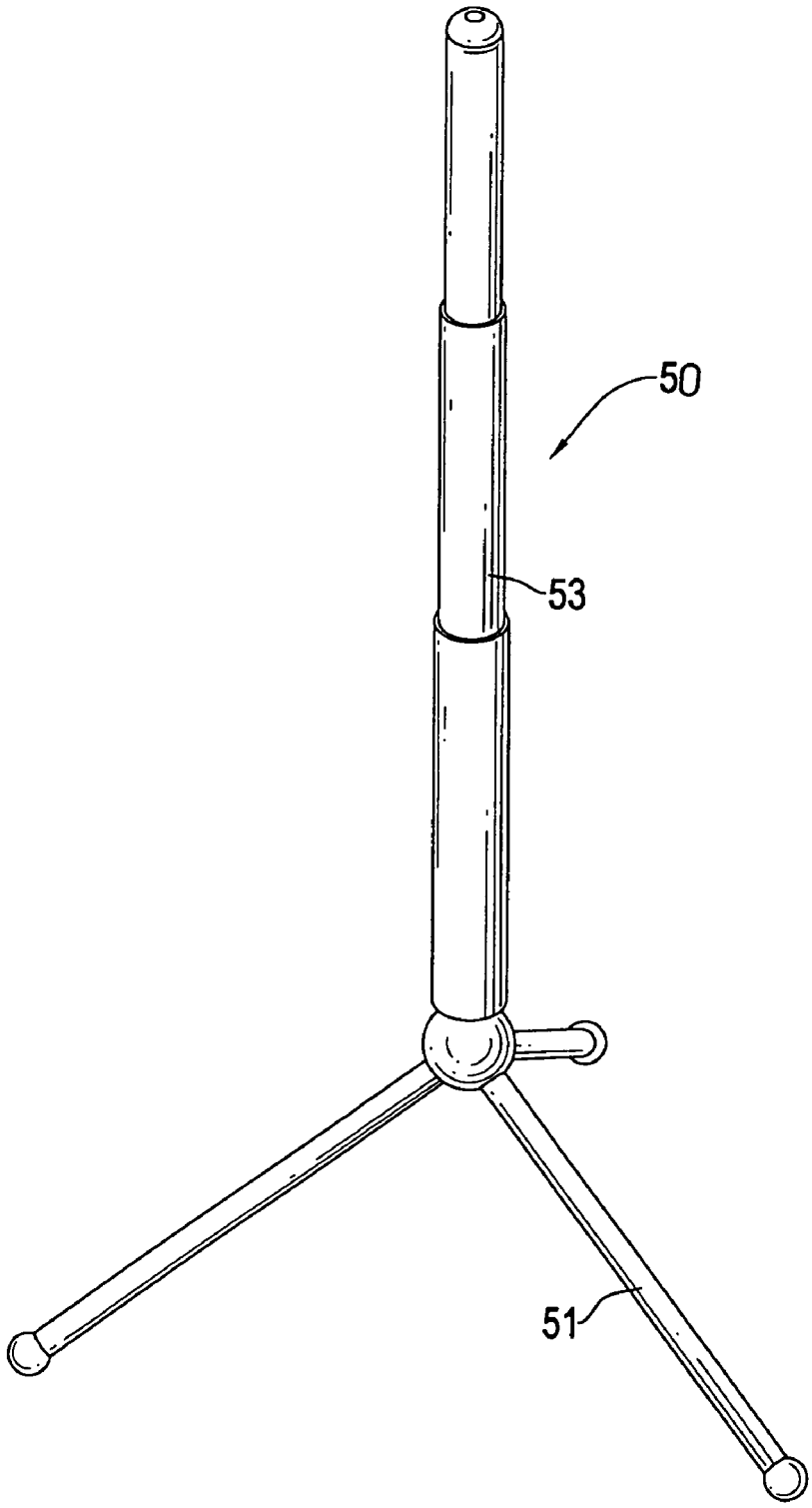
FIG. 6 PRIOR ART
FIG. 6 is a perspective view of a conventional antenna.

Referring to FIGS. 4, 5A and 5B, after the antenna device 10 is integrated with the casing 20, a back of the base 21 is configured with a bearing leg 219. The casing can be set horizontally or vertically with the bearing leg 219 accordingly pivoted. When the casing 20 is set horizontally, the wireless signals of vertical polarized waves can be received, and the wireless signals of the horizontal polarized waves $S_H$ can be received when the casing 20 is set vertically. In this way, the antenna device 10 inside the casing 20 can be easily adjusted to receive signals of the horizontal polarized waves or vertical polarized waves from the transmitters.

Therefore, the objective of the present invention is achieved by horizontally connecting the main rod antenna, the auxiliary rod antenna and the circuit, so as to make the whole antenna structure flat and compact. Thereby the antenna device can be adjusted to any receiving angle easily, so as to match up receiving wireless digital television signals of the horizontal polarized waves or vertical polarized waves from different transmitters. In addition, the antenna device of the present invention also can receive circularly polarized waves however a receiving strength of the circularly polarized waves is much weaker than the horizontal polarized waves or vertical polarized waves. Moreover, the present invention can have a flat box design to facilitate users to adjust placing angles of the antenna device.

While the invention has been described by way of example and in terms of a preferred embodiment, it is to be understood that the invention is not limited thereto. On the contrary, it is intended to cover various modifications and similar arrangements and procedures, and the scope of the appended claims therefore should be accorded the broadest interpretation so as to encompass all such modifications and similar arrangements and procedures.

What is claimed is:

1. An indoor UHF antenna device for a digital television comprising:

a circuit board mainly comprising a digital television signal processing circuit and a connector for connecting with a coaxial cable;

a main rod antenna which is horizontally welded with a signal feeder terminal of the circuit board, so as to be parallel to the circuit board; and an auxiliary rod antenna which is horizontally welded with an earth terminal of the circuit board and keeps a specific wavelength distance with the main rod antenna, wherein the auxiliary rod antenna is provided as a reference signal while the circuit of the circuit board processes a signal received by the main rod antenna, reception of reflected or refracted wireless signals from surrounding obstacles is prevented so as to avoid receiving the same wireless signals repeatedly and thus avoid a signal receiving noise.

2. The indoor UHF antenna device for a digital television as defined in claim 1, wherein the digital television signal processing circuit comprises:

a signal wave filter with a signal feeder terminal connecting to the main rod antenna for capturing a wireless signal of a specific frequency band;

a high anti-noise amplifier connected to an output terminal of the signal wave filter for filtering the noise of the wireless signal and then to amplify and output the wireless signal;

a wave-filter and power supply circuit wherein an input terminal is connected to an output terminal of the high anti-noise amplifier, so as to filter the amplified wireless signal again, and to capture a digital television signal of a UHF frequency band, wherein an output terminal is connected to the connector of the circuit, wherein when the connector is connected to a television via the coaxial cable, D.C. power is provided, and further the wave-filter and power supply circuit comprises inductance and capacitance, thereby when the output terminal of the wave-filter and power supply circuit is connected to the connector, the D.C. power is supplied to the high anti-noise amplifier via the capacitance; and a power regulation circuit wherein an input terminal is connected to a D.C. power, wherein the input D.C. power is outputted to the high anti-noise amplifier via a constant voltage regulator.

3. The indoor UHF antenna device for a digital television as defined in claim 1, wherein the indoor UHF antenna device is placed inside a casing, wherein the casing comprises:

a base comprising a U-shaped cross-section for receiving the circuit board, the main rod antenna and the auxiliary rod antenna;

a lid for covering an opening of the base, and also for covering the circuit board, the main rod antenna and the auxiliary rod antenna; and a plate for covering the lid and reinforcing the base.

4. The indoor UHF antenna device for a digital television as defined in claim 2, wherein the indoor UHF antenna device is placed inside a casing, wherein the casing comprises:

a base comprising a U-shaped cross-section for receiving the circuit board, the main rod antenna and the auxiliary rod antenna;

a lid for covering an opening of the base, and also for covering the circuit board, the main rod antenna and the auxiliary rod antenna; and a plate for covering the lid and reinforcing the base.

5. The indoor UHF antenna device for a digital television as defined in claim 3, wherein a plurality of mounts are configured at a bottom of the base for supporting the main rod antenna and the auxiliary rod antenna.

6. The indoor UHF antenna device for a digital television as defined in claim 4, wherein a plurality of mounts are configured at a bottom of the base for supporting the main rod antenna and the auxiliary rod antenna.

7. The indoor UHF antenna device for a digital television as defined in claim 5, wherein a downward sunken ladder is formed at an inner part of a side upper face of the base, and wherein a plurality of integrated troughs are formed on the ladder, wherein a plurality of integrated feet are formed on an underside of the lid corresponding to the integrated troughs on the side of the base, so that the lid can be integrated with the ladder of the base.

8. The indoor UHF antenna device for a digital television as defined in claim 6, wherein a downward sunken ladder is formed at an inner part of a side upper face of the base, and wherein a plurality of integrated troughs are formed on the ladder, wherein a plurality of integrated feet are formed on an underside of the lid corresponding to the integrated troughs on the side of the base, so that the lid can be integrated with the ladder of the base.

9. The indoor UHF antenna device for a digital television as defined in claim 3, wherein a back of the base is configured with a bearing leg.

10. The indoor UHF antenna device for a digital television as defined in claim 4, wherein a back of the base is configured with a bearing leg.

* * * * *